United States Patent [19]

Hudson et al.

[11] Patent Number: 4,553,667

[45] Date of Patent: Nov. 19, 1985

[54] BOWLING BALL CARRYING CONTAINER

[76] Inventors: John E. Hudson; David B. Yohe, both of Rte. 1, Box 68, Manton, Calif. 96059

[21] Appl. No.: 566,048

[22] Filed: Dec. 27, 1983

[51] Int. Cl.[4] ..... B65D 1/16; B65D 39/10; B65D 85/00

[52] U.S. Cl. ..... 206/315.9; 220/70; 220/293; 220/302

[58] Field of Search ..... 206/315.9; 220/302, 220/293, 298, 301, 70; 285/402, 396, 361

[56] References Cited

U.S. PATENT DOCUMENTS

| | | | |
|---|---|---|---|
| 1,207,813 | 12/1916 | Stockton | 206/315.9 X |
| 1,399,345 | 12/1921 | Henry | 220/302 |
| 1,806,218 | 5/1931 | Reid | 220/302 |
| 1,901,551 | 3/1933 | Cipullo | 220/302 |
| 2,016,773 | 10/1935 | Flynt | 220/302 |
| 3,136,398 | 6/1964 | Platt | 206/315.9 |
| 3,173,442 | 3/1965 | McKillip | 220/301 X |
| 3,308,911 | 3/1967 | Stevens et al. | 206/315.9 |
| 3,690,507 | 9/1972 | Gailus et al. | 220/70 X |
| 4,119,232 | 10/1978 | Thornton | 220/298 X |

FOREIGN PATENT DOCUMENTS

| | | | |
|---|---|---|---|
| 65157 | 1/1956 | France | 220/293 |

*Primary Examiner*—Allan N. Shoap

[57] ABSTRACT

This bowling ball carrying container resembles a large can of a sportsman's favorite brand of beverage, such as soda or beer. Primarily, it consists of a main body imprinted with a brand name of soda or beverage, and the bottom wall includes a curved recess for fitting the contour of a bowling ball received in the container. The main body further includes a lid, having a pair of locking mechanisms for retaining it in place, so as to enable the user to carry the container, and room is provided in the container for the bowler's shoes and other equipment.

1 Claim, 4 Drawing Figures

BOWLING BALL CARRYING CONTAINER

This invention relates to sports equipment carrying devices, and more particularly, to a bowling ball carrying container.

The principal object of this invention is to provide a bowling ball carrying container, which will be unique, in that it will simulate the appearance of a typical soft drink or beer can.

Another object of this invention is to provide a bowling ball carrying container, which will also be novel, in that it will enable bowlers to pick out and purchase such a container, which will simulate their favorite brand of soft drink or beer.

Another object of this invention is to provide a bowling ball carrying container, which will be of such design, as to seat a typical bowling ball properly, and the interior of the structure will also be such, that it will receive the bowler's shoes, and other articles of equipment.

A further object of this invention is to provide a bowling ball carrying container, which will also include a suitable cover and handle combination.

Other objects are to provide a bowling ball carrying container, which is simple in design, inexpensive to manufacture, rugged in construction, easy to use, and efficient in operation.

These, and other objects, will be readily evident, upon a study of the following specification, and the accompanying drawing, wherein.

Figures 1, 2, 3, 4:
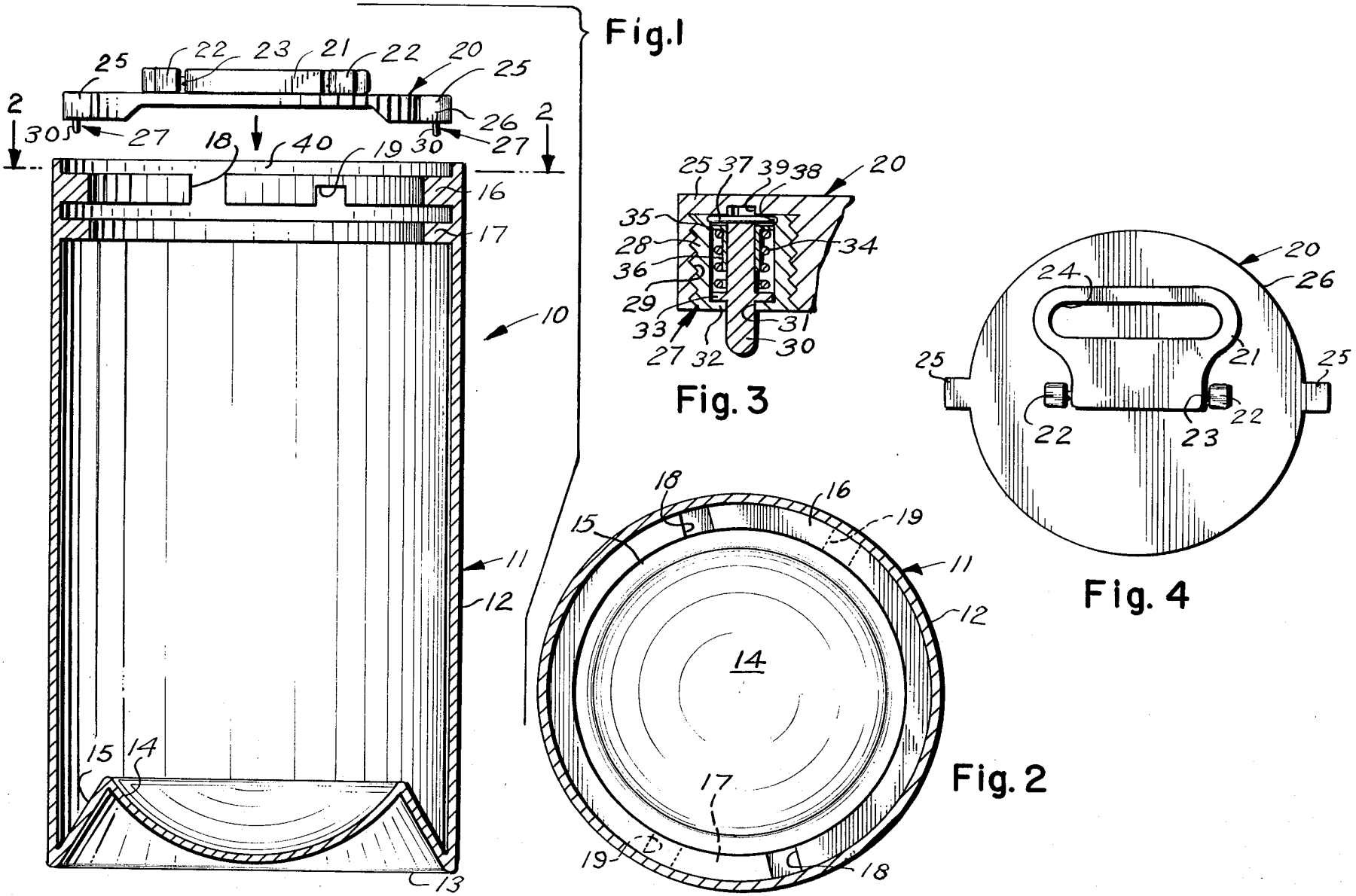
FIG. 1 is a vertical elevational view of the present invention, shown in section, with the cover separated therefrom, for the sake of clarity.
FIG. 2 is a horizontal cross-sectional view taken along the line 2—2 of FIG. 1.
FIG. 3 is an enlarged fragmentary sectional view, and illustrating one of the locking mechanisms thereof.
FIG. 4 is a top plan view of FIG. 1.

Accordingly, a container 10 is shown to include a main body 11, which is of hollow cylindrical configuration, having the brand name of a beverage suitably inscribed or printed on its outer periphery 12, which is not shown. Main body 11 includes a frusto-conical bottom wall 13, which is integrally formed of main body 11. Bottom wall 13 includes an arcuate recess 14 in its top surface 15, which faces upward, and provides a matingly contoured seatrest for seating the user's bowling ball protectively when it is placed within the confines of main body 11, and the height of main body 11 is sufficient, so as to enable the bowler to store his shoes and other equipment therein. A pair of annular and inwardly extending flanges 16 and 17 are integrally attached to the upper portion of main body 11. A pair of oppositely opposed cut-outs 18, through the flange 16, are included, and an off-set pair of similarly disposed recesses 19 are included in the bottom of flange 16, for a purpose which hereinafter will be described.

The cover or lid 20 is provided with a pivotal carrying handle 21, which is pivotally secured between a pair of spaced projections 22, by means of a pin 23 within the base of handle 21. Projections 22 are fixedly secured to the top of lid 20 in a suitable manner (not shown), and handle 21 includes an opening 24 therein, for freely receiving the user's fingers, so as to carry container 10. A pair of oppositely opposed projections 25 are integrally attached, and extend from the outer periphery 26 of lid 20, and are removably received within the cut-out openings 18 of annular flange 16, and when lid 20 is locked into place in main body 11, the projections 25 are received within the recesses 19 of flange 16, and are retained therein by means of the locking mechanisms 27 of lid 20.

The locking mechanisms 27 are a pair, and each includes an externally threaded sleeve 28, which is threaded into a threaded opening 29, provided in the bottom of each projection 25. A plunger pin 30 is received on the longitudinal axis of each sleeve 28, and extends freely and slideably through opening 31 through the bottom of sleeve 28, and the rounded end of pins 30 serve to bear against the top surface of flange 17, when lid 20 is in place in main body 11. Sleeve 28 includes a bottom wall 32, which is flush with the bottom surface of projection 25, and a flange 33, integrally attached to the lower end portion of each pin 30, is urged downwards, by means of one end of coil spring 34, and a flange end 35 of a bushing 36 engages with the opposite end of coil spring 34, and the coil spring 34 urges bushing 36 upwards against a snap-ring 37, which is received in an annular groove (not shown), in the outer periphery of pin 30. The outer periphery of snap-ring 37 is received in an annular groove 38, in the bore of sleeve 28. The opposite end of pin 30 engages within an opening 39 in the top portion of lid 20. The pins 30 of locking mechanisms 27 are normally urged outwards against the flange 17, so as to retain lid 20 in place on the main body 11 of container 10, when the projections 25 are received in recesses 19 of lid 20.

In use, the bowler first places his ball through the opening 40 of main body 11, and seats it in the recess 14, which cradles it. He then places his bowling shoes and other equipment on top of the ball, and takes the lid 20 and urges it down in the opening 40, which is recessed to receive lid 20. The bowler then aligns the projections 25 of lid 20 with openings 18 in flange 16, causing the pins 30 to bear against the top of flange 17. The lid is then rotated clock-wise by the bowler, until the projections 25 align with recesses 19 in the bottom of flange 16, and when hand pressure is released, the springs 34 urge lid 20 upward, thus causing the lid 20, by spring 34 pressure means, to render lid 20 secure within main body 11, enabling the user to transport his ball and equipment to any desired location by the handle 21.

In removing the bowling ball and equipment from container 10, the abovementioned procedure is reversed.

It shall be recognized, that container 10 is also adaptable for storing and transporting other sporting equipment, and insulation means may be placed therein, when desired, so as to store cold or hot beverages, etc.

While various changes may be made in the detail construction, it is understood that such changes will be within the spirit and scope of the present invention, as is defined by the appended claims.

What we now claim is:

1. A bowling ball carrying container, comprising, in combination, a hollow beer can shaped main body having a cylindrical side wall and a circular bottom wall, said bottom wall including an inwardly extending frustro-conical outer portion around a central outwardly extending rounder portion for mating a spherical contour of a bowling ball that is rested thereupon, an upper end of said main body having a full opening for receiving said bowling ball, a bowler's shoes and other accessories into said container, a removable lid for closing said opening, a pair of spaced apart, inwardly extending annular flanges around said opening for retaining said lid therebetween, a pair of radially outwardly extending projections on diametrically opposite side edges of said lid, a pair of diametrically opposite notches in an upper of said flanges for passage of said projections therethrough and a pair of diametrically spaced-apart recesses on an underside of said upper flanges for locking said projections therein, a spring-biased pin extending downwardly from each said projection for bearing against a top side of a lower of said flanges and raising said projections into said recesses for said locking; a handle upon a top of said lid, and a beverage brand name being printed on an outer side of said main body.

* * * * *